US006532847B2

(12) United States Patent
Liou

(10) Patent No.: US 6,532,847 B2
(45) Date of Patent: Mar. 18, 2003

(54) FORCE-SAVING PLIERS

(76) Inventor: Mou-Tang Liou, P.O. Box 63-247, Taichung (TW)

( * ) Notice: Subject to any disclaimer, the term of this patent is extended or adjusted under 35 U.S.C. 154(b) by 157 days.

(21) Appl. No.: 09/784,779

(22) Filed: Feb. 15, 2001

(65) Prior Publication Data

US 2001/0007214 A1 Jul. 12, 2001

Related U.S. Application Data

(63) Continuation-in-part of application No. 09/366,056, filed on Aug. 2, 1999, now abandoned.

(51) Int. Cl.[7] ..... B25B 7/06

(52) U.S. Cl. ..... 81/416; 81/381; 81/383; 30/175

(58) Field of Search ..... 81/342, 381, 383, 81/416; 30/175, 186

(56) References Cited

U.S. PATENT DOCUMENTS

| | | | | | |
|---|---|---|---|---|---|
| 1,796,888 | A | * | 3/1931 | Davis | 81/381 |
| 2,370,308 | A | * | 2/1945 | Hanson | 81/381 X |
| 2,986,962 | A | * | 6/1961 | Ford | 81/342 X |
| 3,308,692 | A | * | 3/1967 | Sato | 81/342 |
| 5,284,487 | A | * | 2/1994 | Hartmeister | 81/381 X |

* cited by examiner

*Primary Examiner*—James G. Smith
(74) *Attorney, Agent, or Firm*—Alan D. Kamrath; Rider, Bennett, Egan & Arundel

(57) ABSTRACT

A pair of pliers includes a first plier body including a first handle attached to a first end thereof and a second end. The first plier body further includes a mediate portion with a first pivotal section and a second pivotal section. A second plier body includes a first end with a slot and a second end that cooperates with the second end of the first plier body for exerting a force on an object between the second end of the first plier body and the second end of the second plier body. The second plier body further includes a mediate portion with a third pivotal section in pivotal engagement with the first pivotal section of the first plier body. The mediate portion of the first plier body and the mediate portion of the second plier body together define a compartment. A third plier body includes a second handle attached to a first end thereof and a second end with a rocker movably received in the compartment. The rocker is in pivotal connection with the second pivotal section of the first plier body. The third plier body further includes a mediate portion with a pin that is slidably extended through the slot of the second plier body. The rocker pivots and translates in the compartment between the first plier body and the second plier body upon manual pivotal operation of the first handle and the second handle.

14 Claims, 8 Drawing Sheets

FORCE-SAVING PLIERS

CROSS REFERENCE TO RELATED APPLICATION

This is a continuation-in-part application of U.S. patent application Ser. No. 09/366,056 filed on Aug. 2, 1999, which is now abandoned.

BACKGROUND OF THE INVENTION

1. Field of the Invention

The present invention relates to a pair of pliers that may cut an object with less force.

2. Description of the Related Art

FIG. 1 of the drawings illustrates a pair of conventional pliers that includes a cutting point 60 and a pivotal pin or axle 40. Upon applying force to the handles of the pliers, an object held between the cutters is out at to cutting point 60. Thc force-saving rate (leverage) for the pliers is the distance B between pivotal axis of the pin 40 and the force-applying point 70 divided by the distance A between pivotal axis of the pin 40 and the cutting point 60. U.S. Pat. No. 3,308,692 to Sato issued on Mar. 14, 1967 discloses a plier-type tool including a stationary member, a movable jaw member, and a drive handle lever. The stationary member includes a jaw portion and a handle portion. The movable jaw is pivotally connected to the stationary member via a pivot between the jaw portion and the handle portion of the stationary member. The drive handle lover is pivotally connected through another pivot to the stationary member so as to cooperate with the handle portion of the stationary member. A pin fixed on the movable jaw member at its rear extension across to pivot between the jaw portion and the handle portion engages with a slot defined in the drive handle lever. Thus, the pin is slidable along the slot. It was found that the leverage of such a plier-type loot is insufficient, as the user still has to apply a relatively large force to cut an object held between the cutting edges of the jaw portion and the movable jaw member, respectively. The present invention is intended to provide a pair of pliers having a higher force-saving rate (leverage).

SUMMARY OF THE INVENTION

Other objects, advantages, and novel features of the invention will become more apparent from the following detailed description when taken in conjunction with the accompanying drawings.

DETAILED DESCRIPTION OF THE PREFERRED EMBODIMENT

Figure 2:
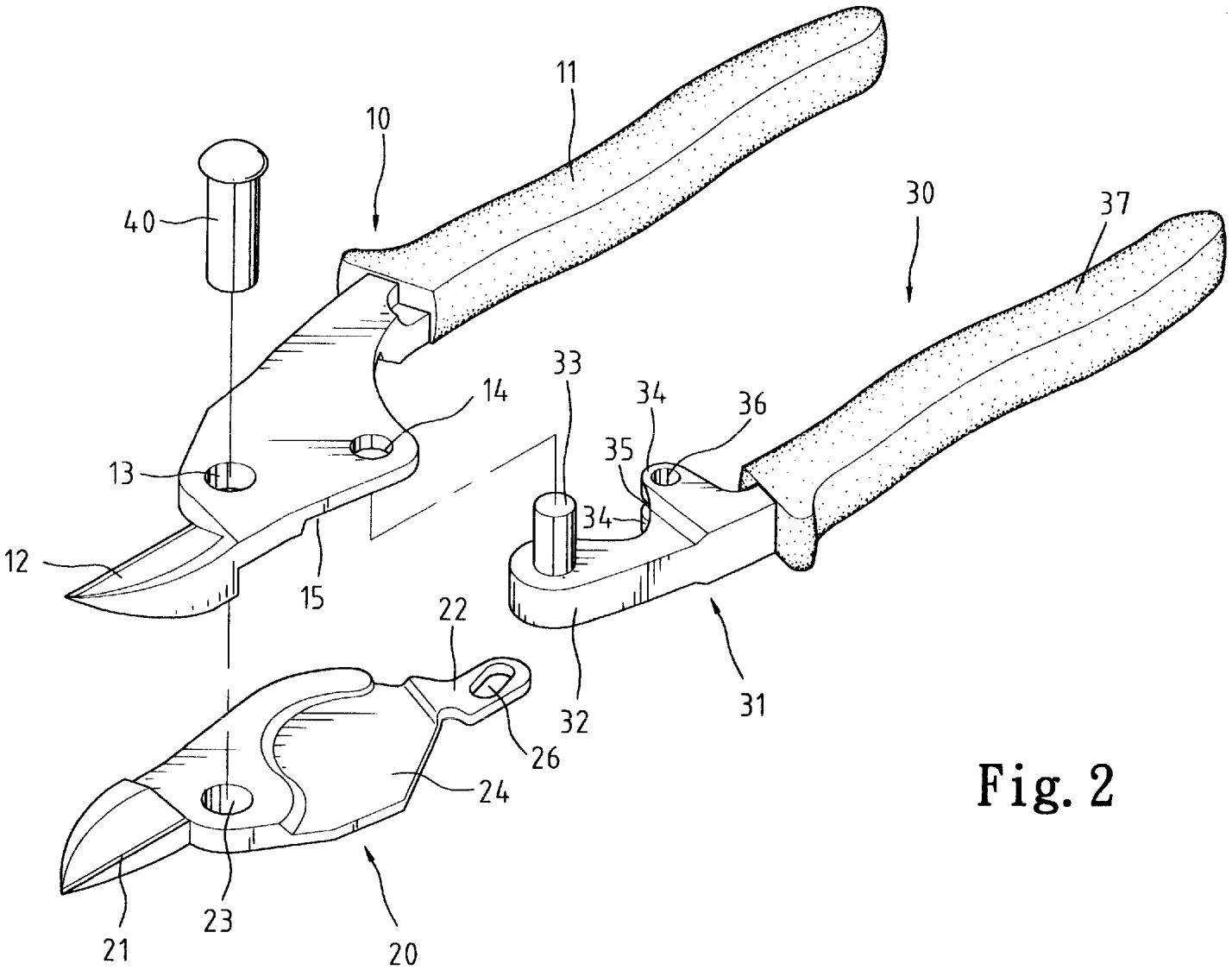
FIG. 2 is an exploded perspective view of a pair of pliers in accordance with the present invention.
Figure 3:
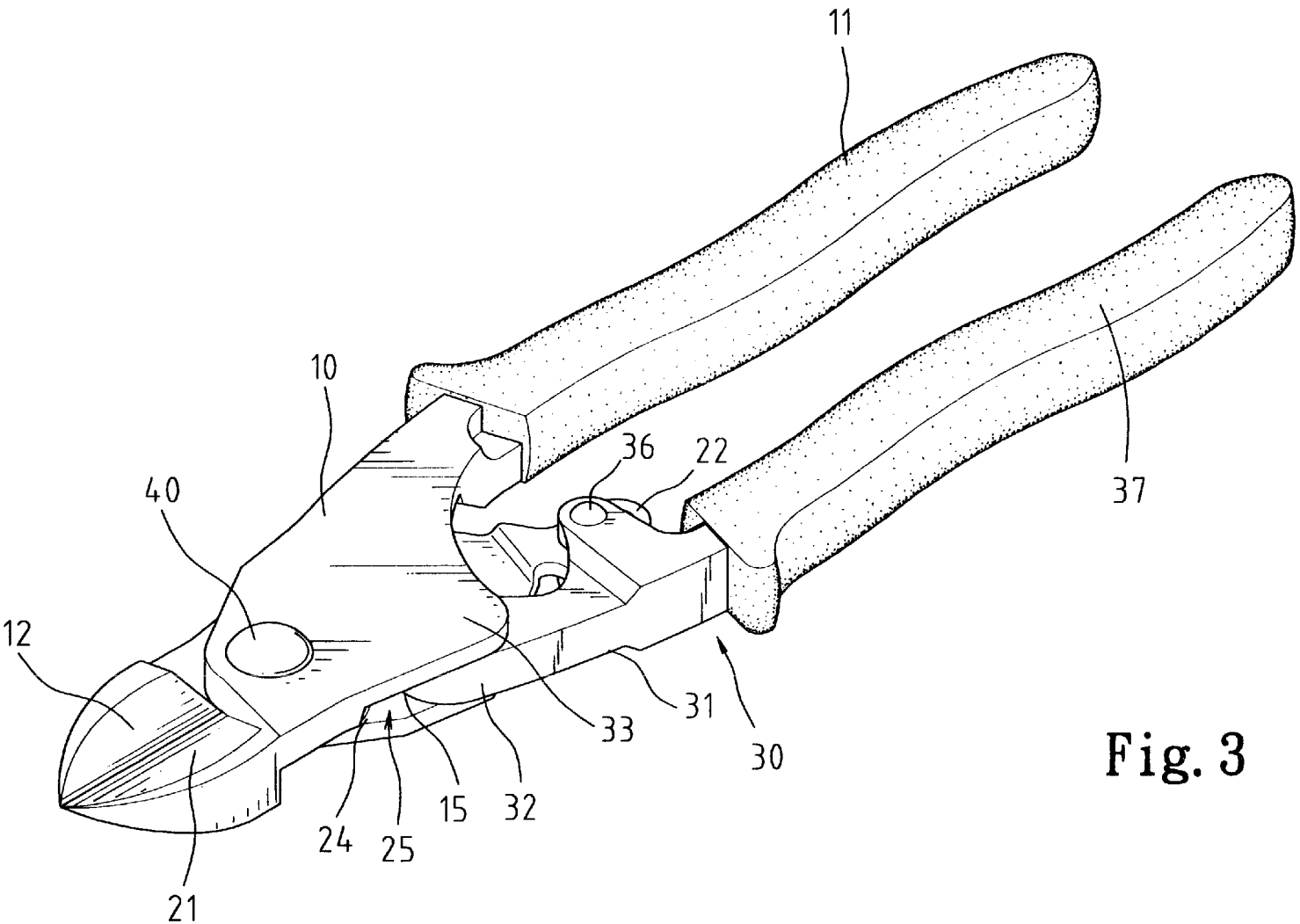
FIG. 3 is a perspective view of the pair of pliers in accordance with the present invention.

Referring to FIGS. 2 and 3, a pair of pliers in accordance with the present invention generally includes a first plier body 10 having a handle 11 attached to an end thereof. The other end of the first plier body 10 includes a cutter 12 formed thereon. A mediate portion of the first plier body 10 includes a first pivotal hole 13 and a second pivotal hole 14 defined therein. A recessed section 15 is formed on a side of the mediate portion of the first plier body 10 and includes the second pivotal hole 14.

The pair of pliers of the invention further comprises a second plier body 20 that includes a first end 22 with a slot 26 defined therein and a second end on which a cutter 21 is formed, the cutter 21 being aligned with the cutter 12 of the first plier body 10. The second plier body 20 further includes a recessed section 24 defined in a mediate portion thereof and aligned with the recessed section 15 of the first plier body 10. More specifically, the recessed sections 24 and 15 together define a compartment 25 (FIG. 3). In addition, a pivotal hole 23 is defined in the mediate portion of the second plier body 20 and aligned with the first pivotal hole 13.

The pair of pliers of the invention further comprises a movable plier body 30 that includes an operative member 31 having a first end to which a handle 37 is securely attached. Formed on a second end of the operative member 31 is a rocker 32 having a peg 33 projecting therefrom and extending in a direction perpendicular to a longitudinal axis of the third plier body 30. The rocker 32 has a thickness sized to be movably received in the compartment 25 defined by the recessed sections 24 and 15. The peg 33 is extended through the second pivotal hole 14, thereby allowing pivotal movement of the rocker 32 relative to the first plier body 10. Referring to FIGS. 2 and 3, the operative member 31 further includes a pair of lugs 34 projecting from a mediate portion thereof. The lugs 34 have a space 35 therebetween. The first end 22 of the Second plier body 20 extends through the space 35 and a pin 36 extends through the lugs 34 and the slot 26 and then riveted. As a result, the movable plier body 30 and the second plier body 20 move relative to each other.

The first end 22 of the second plier body 70 is in the form of an elongated extension that projects outward from the mediate portion of the second plier body 20 and extends away from the second end of the second plier body 20 allowing easy assembly with the lugs 34 of the movable plier body 30. The slot 26 extends along a direction that is at an angle with a longitudinal axis of the second plier body 20 such that the handles 11 and 37 can be opened to a larger extent.

A pivotal pin 40 is extended through the holes 13 and 23 and then riveted, thereby allowing relative pivotal movements between the first plier body 10 and the second plier body 20.

Figure 4:
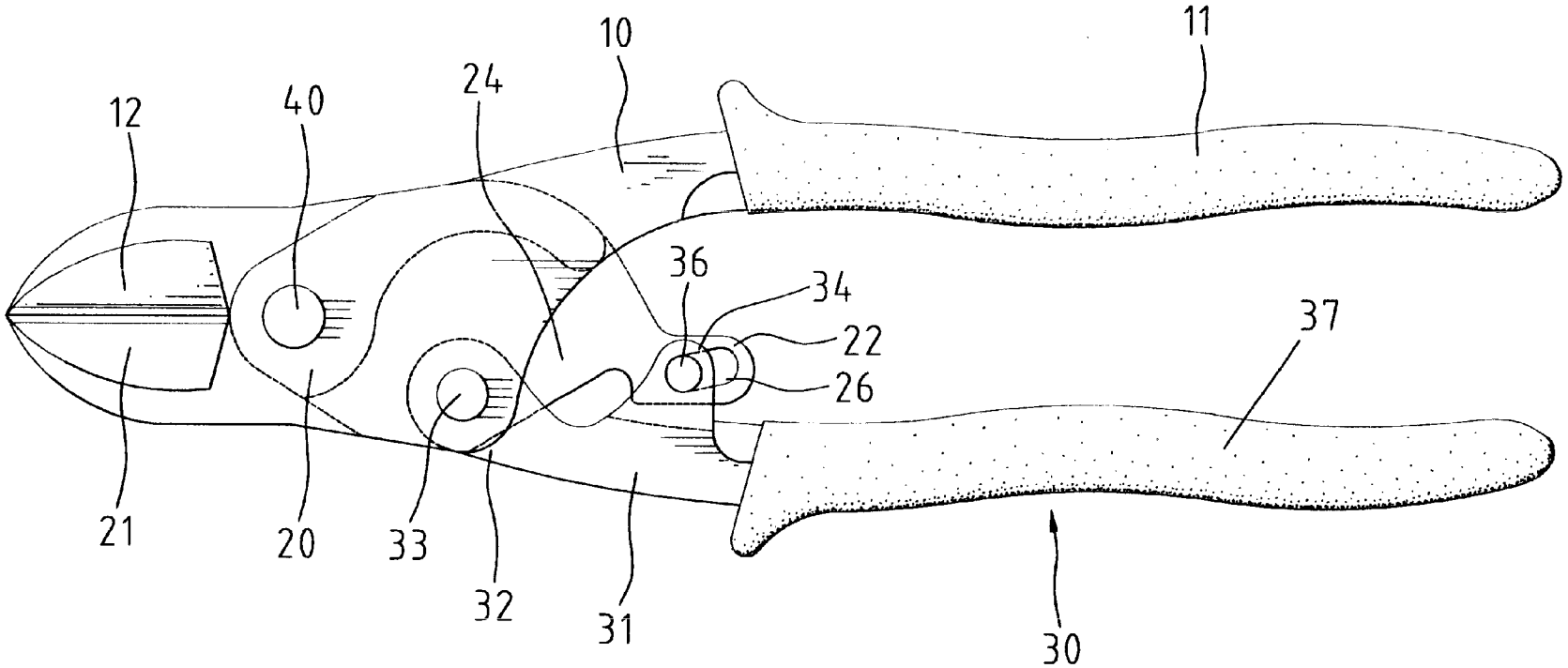
FIG. 4 is a top view of the pair of pliers in accordance with the present invention, wherein the pliers are in a closed status.
Figure 5:
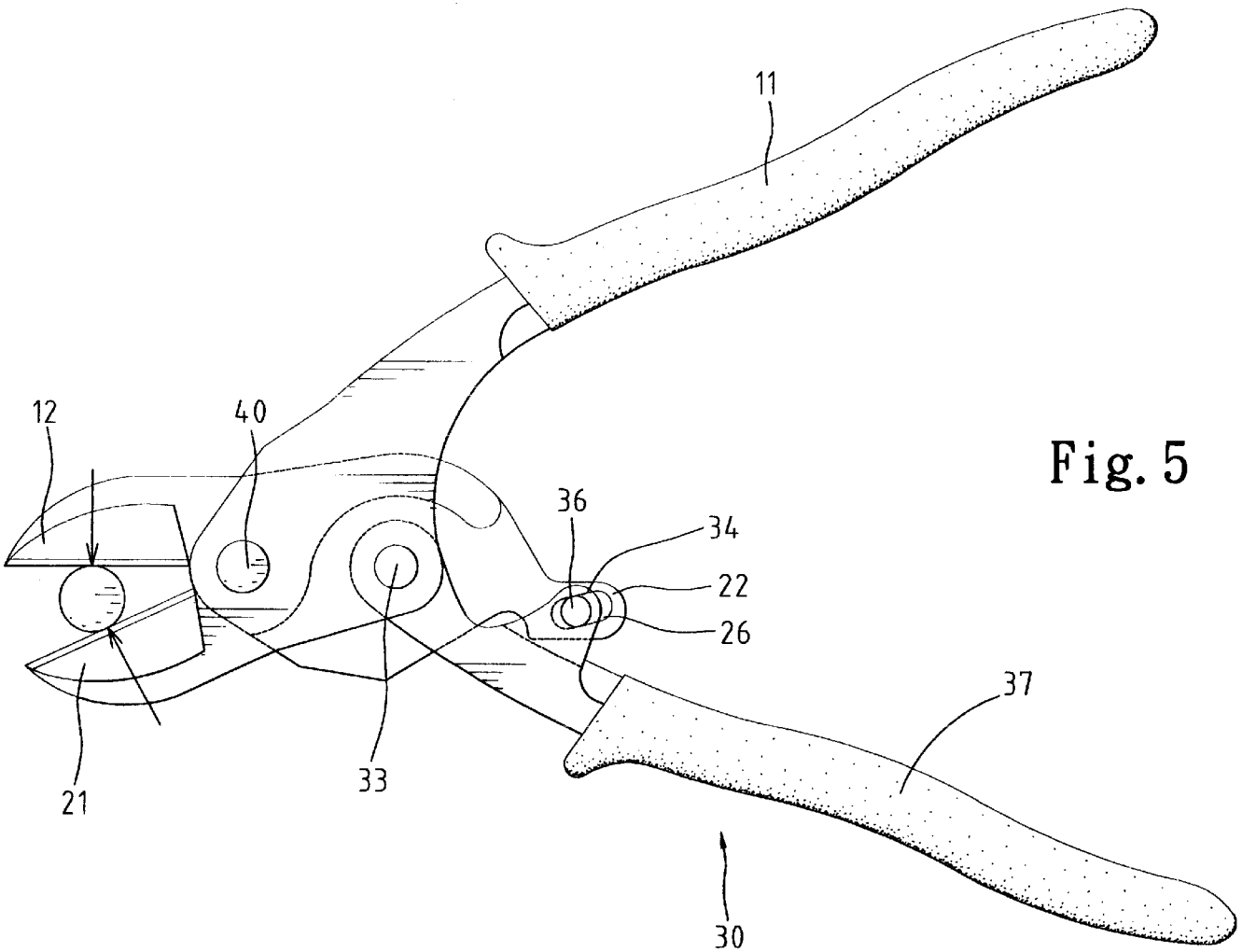
FIG. 5 is a top view similar to FIG. 4, wherein the pliers are in an opened status.

FIG. 4 is a top view of the pair of pliers in a closed status and FIG. 5 is a top view of the pair of pliers in an opened status. Comparing FIG. 5 with FIG. 4, pivotal and translational movement of the rocker 32 causes movement of the peg 26. During cutting of an object (FIG. 5) between the cutters 12 and 21, the slot 26 of the second plier body 20 guides movement of the third plier body 30. And the rocker 32 sways and thus changes the position of the peg 33 to achieve the required force-saving effect. In addition, during cutting of the object (FIG. 6) between the cutters 12 and 21, the peg 36 bears against lateral walls defining the slot 26 to prevent rotational movement.

Figure 1:
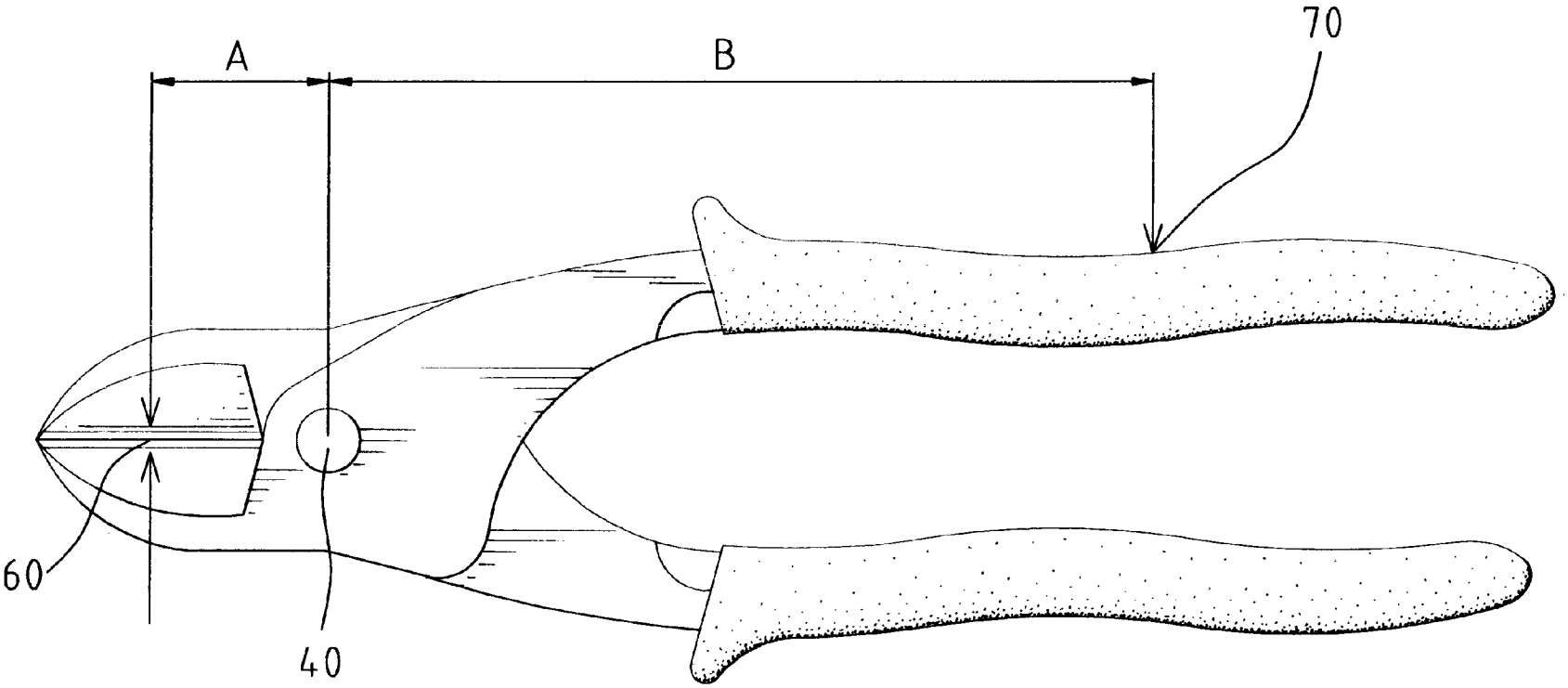
Fig. 1 PRIOR ART
FIG. 1 is a top view of a pair of conventional pliers.
Figure 6:
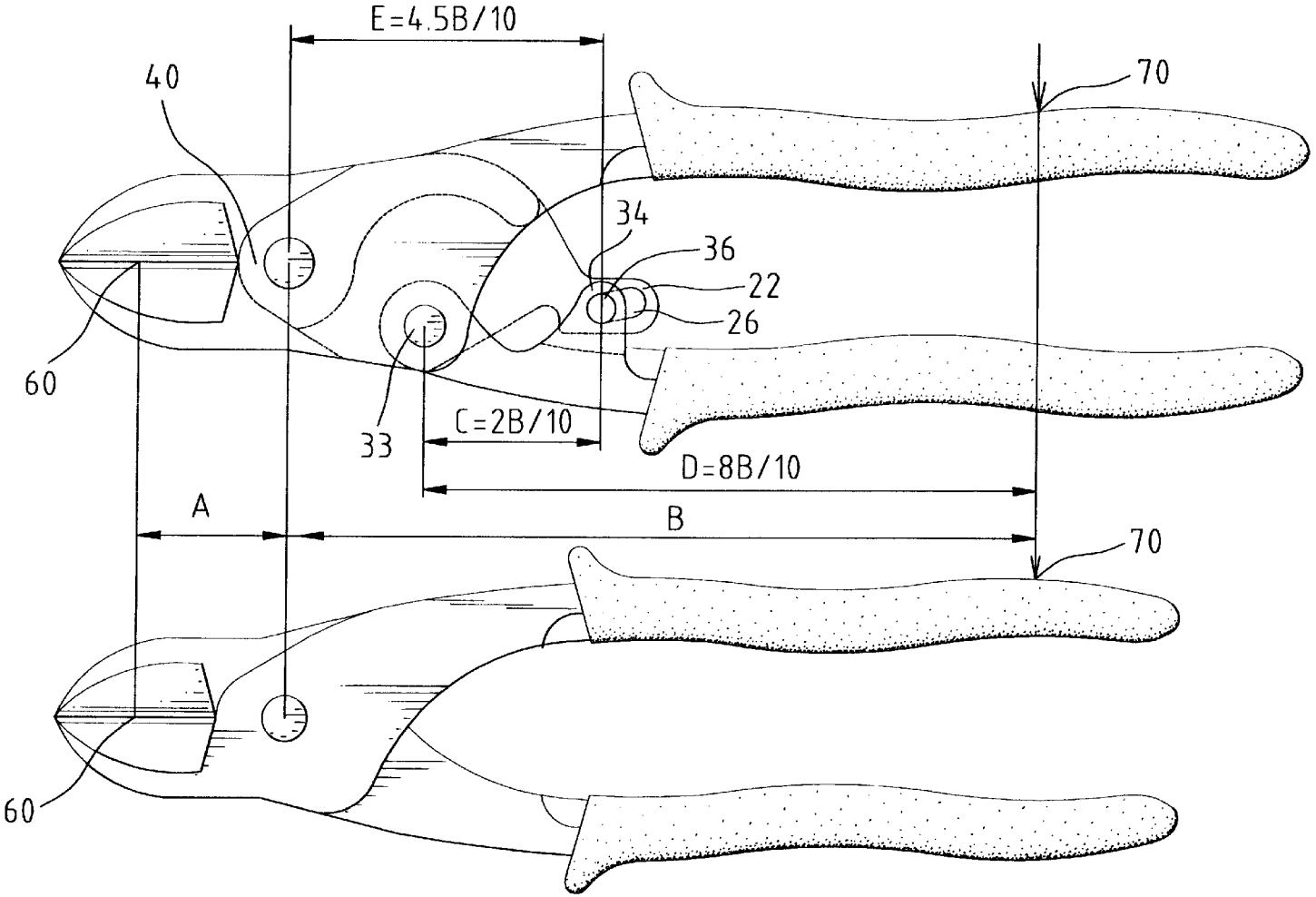
FIG. 6 is a top view illustrating the difference in force saving rate (leverage) between the pair of pliers in accordance with the present invention and the pair of conventional pliers in FIG. 1.

FIG. 6 illustrates the pair of conventional pliers in FIG. 1 and a pair of pliers of the invention having the same size as the pliers in FIG. 1. In the pair of conventional pliers (the lower one), the force-saving rate (B/A) is the distance B between the force-applying point 70 and pivotal axis of the pin 40 divided by the distance A between pivotal axis of the pin 40 and the cutting point 60. In the pair of pliers of the invention, the distance between the force-applying point 70 and pivotal axis of the pin 40 is also B, and the distance between pivotal axis of the pin 40 and the cutting point 60 is also A. In addition, the distance D between pivotal axis of the peg 33 and the force-applying point 70 is about 0.8B; the distance E between the pivotal axis of the pin 40 and the force-acting point (i.e., the axis of the pin 36) is about 0.45B; and the distance C between the pivotal axis of the peg 33 and the force-acting point (i.e., the axis of the pin 36) is about 0.2B. The ratio between B, C, D, and E is determined upon numerous tests. The overall force-saving rate (leverage) of the pair of pliers of the invention, therefore, is D/C*E/A= 0.8B/0.2B*0.45B/A=1.8B/A. This is much higher than that provided by the pair of conventional pliers. Thus, the pair of pliers of the present invention indeed provides a higher force-saving rate (leverage).

Figure 7:
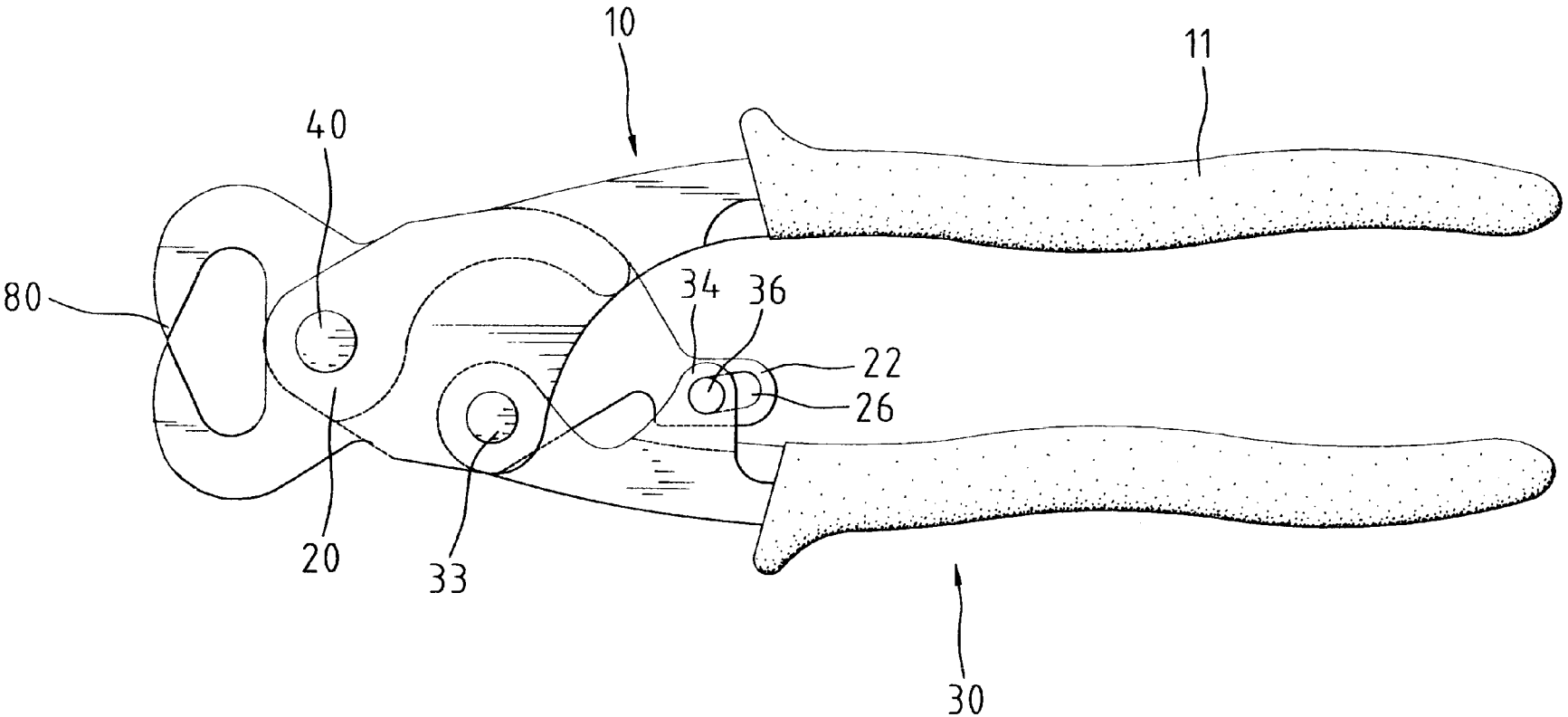
FIG. 7 is a top view of another embodiment of the pair of pliers in accordance with the present invention, wherein the pliers are in a closed status.
Figure 8:
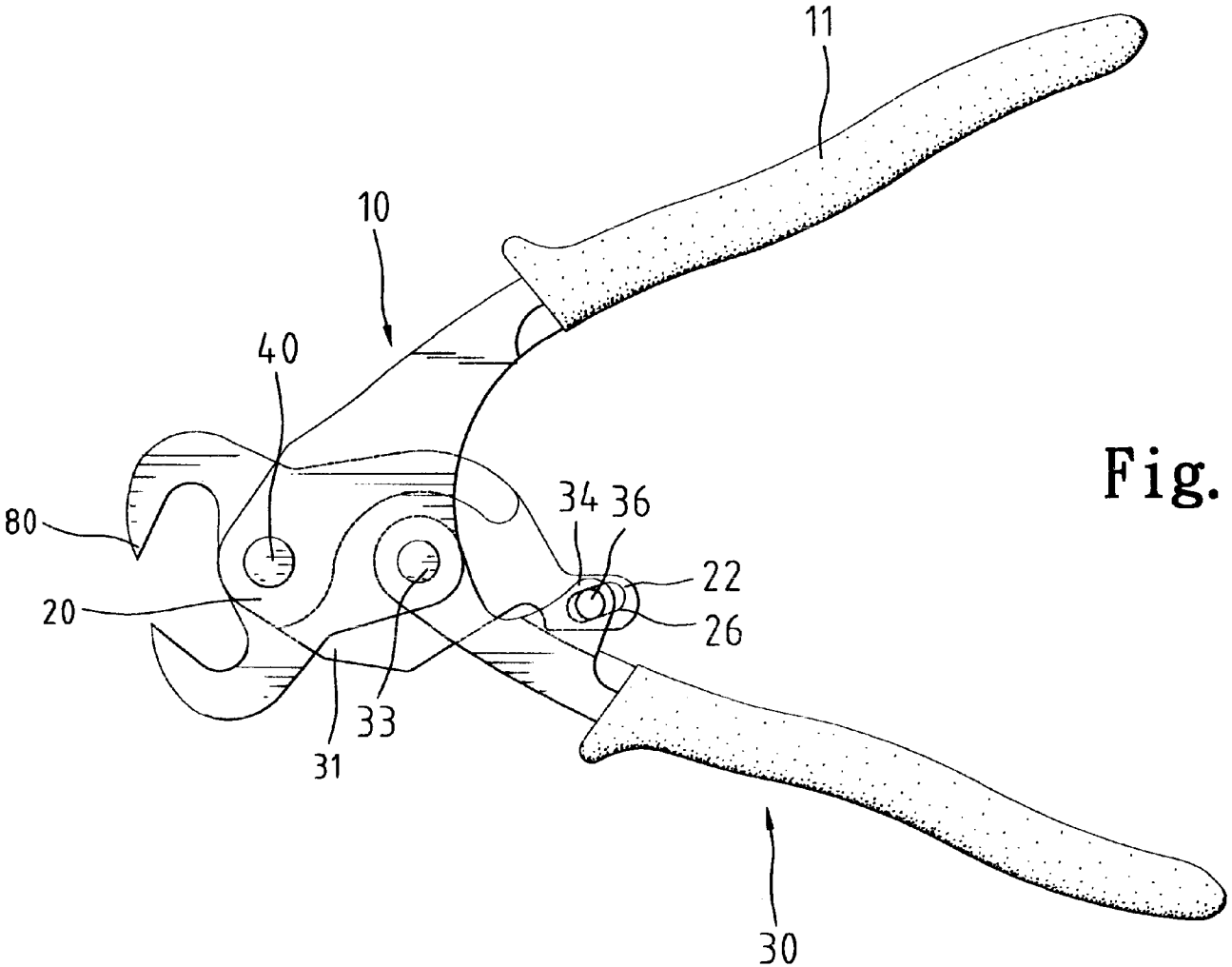
FIG. 8 is a top view similar to FIG. 7, wherein the pliers are in an opened status.

FIGS. 7 and 8 illustrate another type of pliers constructed in accordance with the present invention, the only difference of this embodiment from the above embodiment resides in the pincers 80 that replace the cutters in the above embodiment.

Although the invention has been explained in relation to its preferred embodiment, it is to be understood that many other possible modifications and variations can be made without departing from the scope of the invention as hereinafter claimed.

What is claimed is:

1. A pair of pliers comprising:

a first plier body including a first handle attached to a first end thereof and a second end, the first plier body further including a mediate portion with a first pivotal section and a second pivotal section;

a second plier body including a first end and a second end that cooperates with the second end of the first plier body for exerting a force on an object between the second end of the first plier body and the second end of the second plier body, the second plier body further including a mediate portion with a third pivotal section in pivotal engagement with the first pivotal section of the first plier body;

a third plier body including a second handle attached to a first end thereof and a second end with a rocker, the rocker being in pivotal connection with the second pivotal section of the first plier body, the third plier body further including a mediate portion with a portion slidably guided by and engaged with the first end of the second plier body;

a pair of lugs having a space therebetween and projecting from the mediate portion of the third plier body, the first end of the second plier body extending through the space and having a slot; and a pin extending through the lugs of the third plier body and the slot of the second plier body;

whereby the rocker pivots and translates between the first plier body and the second plier body upon manual pivotal operation of the first handle and the second handle.

2. The pair of pliers as claimed in claim 1, with the mediate portion of the first plier body and the mediate portion of the second plier body together defining a compartment, and with the rocker being movably received in the compartment so that the rocker pivots and translates in the compartment.

3. The pair of pliers as claimed in claim 2, with the mediate portion of the first plier body including a first recessed section, with the mediate portion of the second plier body including a second recessed section, and with the first recessed section and the second recessed section together defining the compartment.

4. The pair of pliers as claimed in claim 2, with the slot extending along a direction that is at an angle with a longitudinal axis of the second plier body.

5. The pair of pliers as claimed in claim 2, with the rocker including a peg extending in a direction perpendicular to a longitudinal axis of the third plier body, and with the second pivot section of the first plier body including a hole for pivotally receiving the peg.

6. The pair of pliers as claimed in claim 2, with the first end of the second plier body being in the form of an elongated extension extending outwardly away from the mediate portion of the second plier body.

7. The pair of pliers as claimed in claim 6, with the elongated extension of the second plier body containing the slot.

8. The pair of pliers as claimed in claim 7, with the slot extending along a direction that is at an angle with a longitudinal axis of the second plier body.

9. The pair of pliers as claimed in claim 6, with the rocker including a peg extending in a direction perpendicular to a longitudinal axis of the third plier body, and with the second pivot section of the first plier body including a hole for pivotally receiving the plug.

10. The pair of pliers as claimed in claim 1, with the slot extending along a direction that is at an angle with a longitudinal axis of the second plier body.

11. The pair of pliers as claimed in claim 1, with the rocker including a peg extending in a direction perpendicular to a longitudinal axis of the third plier body, and with the second pivot section of the first plier body including a hole for pivotally receiving the peg.

12. The pair of pliers as claimed in claim 1, with the first end of the second plier body being in the form of an elongated extension extending outwardly away from the mediate portion of the second plier body.

13. The pair of pliers as claimed in claim 12, with the elongated extension of the second plier body containing the slot.

14. The pair of pliers as claimed in claim 13, with the slot extending along a direction that is at an angle with a longitudinal axis of the second plier body.

* * * * *